US009675217B2

(12) United States Patent
Hagleitner

(10) Patent No.: US 9,675,217 B2
(45) Date of Patent: Jun. 13, 2017

(54) DISPENSING SYSTEM, REFILL FOR A DISPENSER, AND SUPPORT BAR FOR A DISPENSER ROLL

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 343 days.

(21) Appl. No.: 14/465,124

(22) Filed: Aug. 21, 2014

(65) Prior Publication Data

US 2014/0361117 A1 Dec. 11, 2014

Related U.S. Application Data

(63) Continuation of application No. PCT/AT2013/000031, filed on Feb. 20, 2013.

(30) Foreign Application Priority Data

Feb. 21, 2012 (AT) ..... A 219/2012

(51) Int. Cl.
*B65H 16/06* (2006.01)
*A47K 10/38* (2006.01)
*A47K 10/32* (2006.01)

(52) U.S. Cl.
CPC ..... *A47K 10/38* (2013.01); *A47K 10/3845* (2013.01); *A47K 2010/3206* (2013.01); *A47K 2010/3233* (2013.01)

(58) Field of Classification Search
CPC ..... A47K 10/38; A47K 10/3845; A47K 2010/3233; A47K 2010/3206
See application file for complete search history.

(56) References Cited

U.S. PATENT DOCUMENTS 2,903,734 A 9/1959 Inman
5,495,997 A * 3/1996 Moody ..... A47K 10/38 242/560
5,669,576 A * 9/1997 Moody ..... A47K 10/38 242/560.3
5,697,576 A 12/1997 Bloch et al.
(Continued)

FOREIGN PATENT DOCUMENTS

AR 015566 A1 5/2001
CN 1177331 A 3/1998
(Continued)

*Primary Examiner* — William A Rivera
(74) *Attorney, Agent, or Firm* — Laurence A. Greenberg; Werner H. Stemer; Ralph E. Locher

(57) ABSTRACT

A dispensing system has a dispenser for sections of a material web wound onto a roll. A support bar is provided, on each end, a bearing journal protruding out from the roll. At least one of the two bearing journals has a mating surface which is not designed as a rotational surface. The dispenser has a guide for each bearing journal that extends to a dispensing position. A counter surface for the mating surface is provided at the beginning of the guide for each bearing journal that has the mating surface. The insertion of the roller into the dispenser is only possible if the mating surface coincides with the counter surface, which extends to in the dispensing position. The roller is rotatably arranged about the central area of the supporting rod, which does not rotate in the dispensing position.

3 Claims, 3 Drawing Sheets

(56) References Cited

U.S. PATENT DOCUMENTS

| | | | | |
|---|---|---|---|---|
| 5,873,542 | A * | 2/1999 | Perrin | A47K 10/3836 242/560 |
| 6,070,821 | A | 6/2000 | Mitchell | |
| 6,592,068 | B2 * | 7/2003 | Taylor | A47K 10/38 242/594.4 |
| 6,659,391 | B1 | 12/2003 | Faulks et al. | |
| 6,688,551 | B1 | 2/2004 | He et al. | |
| 6,702,225 | B2 | 3/2004 | Newman et al. | |
| 7,828,240 | B2 * | 11/2010 | Hagleitner | A47K 10/38 242/598.3 |
| 7,832,678 | B2 * | 11/2010 | Hjort | A47K 10/38 242/559.3 |
| 7,954,405 | B2 | 6/2011 | Kling | |
| 8,256,644 | B2 | 9/2012 | Orgna | |
| 2004/0050993 | A1 | 3/2004 | Green et al. | |
| 2008/0121750 | A1 | 5/2008 | Hagleitner | |
| 2014/0353418 | A1 * | 12/2014 | Hagleitner | A47K 10/3845 242/599.2 |

FOREIGN PATENT DOCUMENTS

| | | | |
|---|---|---|---|
| CN | 1183032 | A | 5/1998 |
| CN | 1353589 | A | 6/2002 |
| DE | 8912807 | U1 | 2/1990 |
| EP | 1927308 | A1 | 6/2008 |
| TW | M393275 | U | 12/2010 |
| WO | 0182764 | A1 | 11/2001 |
| WO | 2004023961 | A1 | 3/2004 |
| WO | 2006071148 | A1 | 7/2006 |
| WO | 2007035139 | A1 | 3/2007 |

* cited by examiner

DISPENSING SYSTEM, REFILL FOR A DISPENSER, AND SUPPORT BAR FOR A DISPENSER ROLL

CROSS-REFERENCE TO RELATED APPLICATION

This application is a continuation, under 35 U.S.C. §120, of copending international application No. PCT/AT2013/000031, filed Feb. 20, 2013, which designated the United States; this application also claims the priority, under 35 U.S.C. §119, of Austrian patent application A 219/2012, filed Feb. 21, 2012; the prior applications are herewith incorporated by reference in their entirety.

BACKGROUND OF THE INVENTION

Field of the Invention

The invention relates to a dispensing system having a dispenser and a material web, wound to form a roll, which is disposed on a support bar having bearing journals projecting on both sides that can be inserted into guides in the dispenser. At least one of the two bearing journals is provided with at least one mating surface which is not configured as a rotation surface.

A surface which is not configured as a rotation surface here is understood to be a surface of which the generatrix varies in distance to the axis of the bearing journal. Surfaces which are not configured as a rotation surface, above all, are planar, if applicable also curved, lateral surfaces of webs or grooves which are provided on end sides on the bearing journals, stepped surfaces on the end of the bearing journal and/or a prismatic skin surface on the end portion of the bearing journal.

The rolls comprise various material webs which are wound onto cores and/or also wound in a coreless manner and are subsequently equipped with the support bars extending therethrough in order to be able to unroll the material web in a dispenser. This is particularly valid when the rolls are cut from a roll strand, as is the case in general with domestic roll paper, sanitary roll paper, toilet roll paper, etc. Receptacles or guides for rolls of this type in dispensers generally display grooves into which the bearing journals are guided. Since the correct arrangement of the rolls has to be taken into account in order for the end of the material web to always hang down from the roll on the same side, the bearing journals and the associated guides on the two sides are configured so as to be different.

In particular in the case of low-value material webs, such as, for example, in the case of domestic roll paper, toilet roll paper, other sanitary roll papers, the materials also used for the bearing journals are rather cost effective and thus display only sufficient stability or strength in order to enable the application. The bearing journals, despite the unequivocal assignment by way of the different design of the two sides, are thus not safe from damages which may be caused by forcible attempts at placing the roll into the dispenser in an incorrect manner.

A support bar of this type and a dispenser into which rolls having the support bar projecting on both sides are inserted are known are known from my earlier disclosure in European patent application EP 1 927 308 and its counterpart publication US 2008/121750 A1. There, a bearing journal of the support bar has an end flange which is spaced apart from the central region of the support bar by a circumferential groove and which is, on its end side, provided with a groove, the side walls of which in each case represent a mating surface which is not configured to be a rotation surface. The end flange of the bearing journal can be slotted into an undercut guide in the side wall of the dispenser, a web-like protrusion being provided at the commencement of said guide that corresponds to the end-side groove in the bearing journal and the side faces of said protrusion thus forming counter surfaces to the mating surfaces of the groove. During insertion, the roll and/or the bearing journal, therefore, have to be rotated such that coincidence of the two surfaces is achieved. Only then may the roll be pushed into the dispenser. Since the support bar, in the central region, displays webs which stick out and on which the wound material web is held in a rotationally fixed manner, such that the support bar rotates together with the roll when the material web is drawn off, the web-like protrusion terminates far before the dispensing position of the roll and the bearing journals, in the dispensing position of the roll, are able to rotate in an arbitrary manner.

SUMMARY OF THE INVENTION

It is accordingly an object of the invention to provide a dispensing system which further improves the heretofore-known devices of this general type and which provides for simplifications both on the dispenser and on the support bars, without sacrificing the given advantages of the dispensing system known from the above-mentioned EP 1 927 308 and US 2008/121750 A1.

With the above and other objects in view there is provided, in accordance with the invention, dispensing system, comprising:

a dispenser for dispensing portions of a material web wound on a roll that have to be severed;

a support bar formed with a central region supporting at least one material web wound to form the roll, said support bar, on each end thereof, having a respective bearing journal of two bearing journals projecting from the roll;

a mating surface formed on at least one of said two bearing journals and not configured as a rotation surface;

said dispenser having a respective guide for each of said two bearing journals extending from a commencement position and ending in a dispensing position; and said guide, for each of said bearing journals provided with said mating surface, having a counter surface at said commencement position formed to enable an insertion of the roll into said dispenser only when said mating surface and said counter surface coincide;

wherein said roll is rotatably disposed on said central region of said support bar, and said support bar is rotationally fixed in said guide.

In other words, the objects of the invention are achieved in that the counter surface of the dispenser, on the guide, extends up into the dispensing position, and that the roll is rotatably disposed on the central region of the support bar which, in the dispensing position, is rotationally fixed.

It is preferably provided here that the bearing journal, in the end side, has a groove, and that the guide on the dispenser in its entire length is formed by a projecting ridge onto which the groove can be pushed.

A refill having a roll which is disposed on a support bar having two bearing journals of which at least one bearing journal is guided in a rotationally fixed manner at and/or on the guide of the dispenser, provides for the use in the dispensing system that the roll is rotationally disposed on the central region of the support bar. The rotatable arrangement may be achieved by clearance between the roll and the support bar, on the one hand. However, it is preferably provided that the innermost winding of the roll encloses the central region of the support bar in such a manner that a breakaway torque of at most 0.2 Nm, preferably 0.1 Nm, has to be introduced for drawing off the material web. A follow-on torque for further unwinding the material web is preferably between 0.0025 and 0.1 Nm, preferably 0.05 Nm, such that said material web can be drawn off in the usual manner and with a slight braking effect.

On a support bar for a material web which is wound to form a roll, which on each end displays a bearing journal lying in the longitudinal axis of the support bar, wherein at least one of the two bearing journals is provided with at least one mating surface which is not configured to be a rotation surface, it is provided for use in the dispensing system according to the invention that the diameter of the second bearing journal is smaller than the diameter of the central region of the support bar that is provided between the two bearing journals.

This, above all, facilitates equipping material webs which are wound in a coreless manner and cut-to-length from a strand, since the reduced diameter of the second bearing journal, which in particular terminates in a rounded manner, can be slotted into the often very small centric opening of the coreless winding.

It is preferably provided in a further embodiment of the support bar that the central region which is provided for the rotatable arrangement of the roll, between the two bearing journals, displays a cylindrical outer contour, the compact surface of which is preferably interrupted by spaces in the material.

Other features which are considered as characteristic for the invention are set forth in the appended claims.

Although the invention is illustrated and described herein as embodied in dispensing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
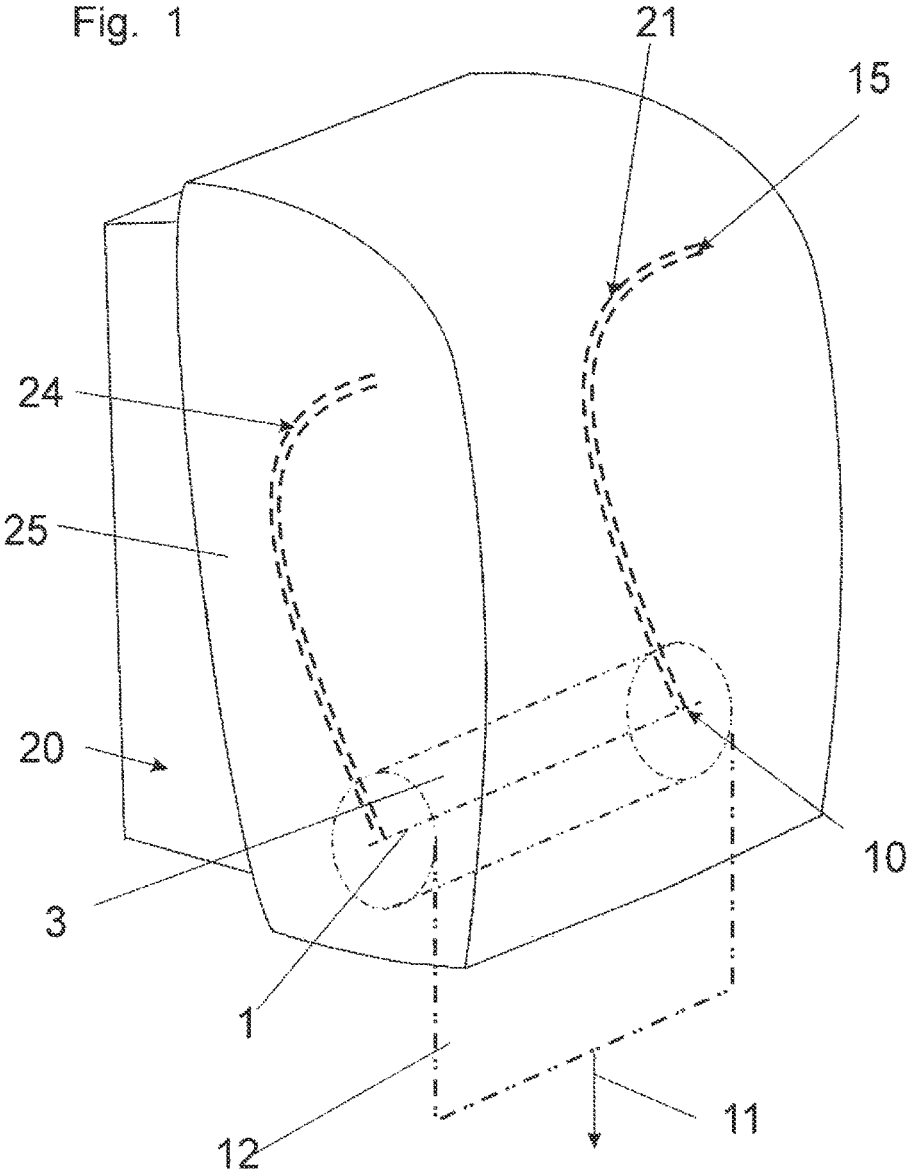
FIG. 1 shows a schematic perspective view of a dispenser equipped with a dispensing material roll.
Figure 2:
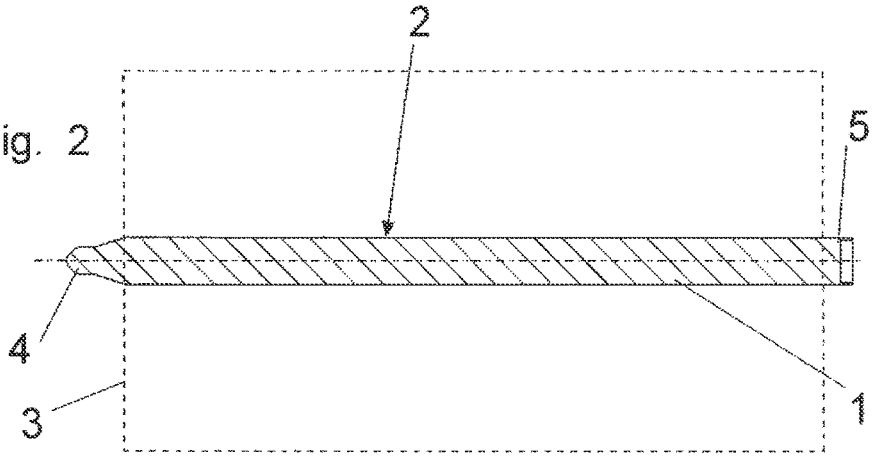
FIG. 2 shows a longitudinal section through a support bar with an material roll indicated in dashed lines.
Figure 7:
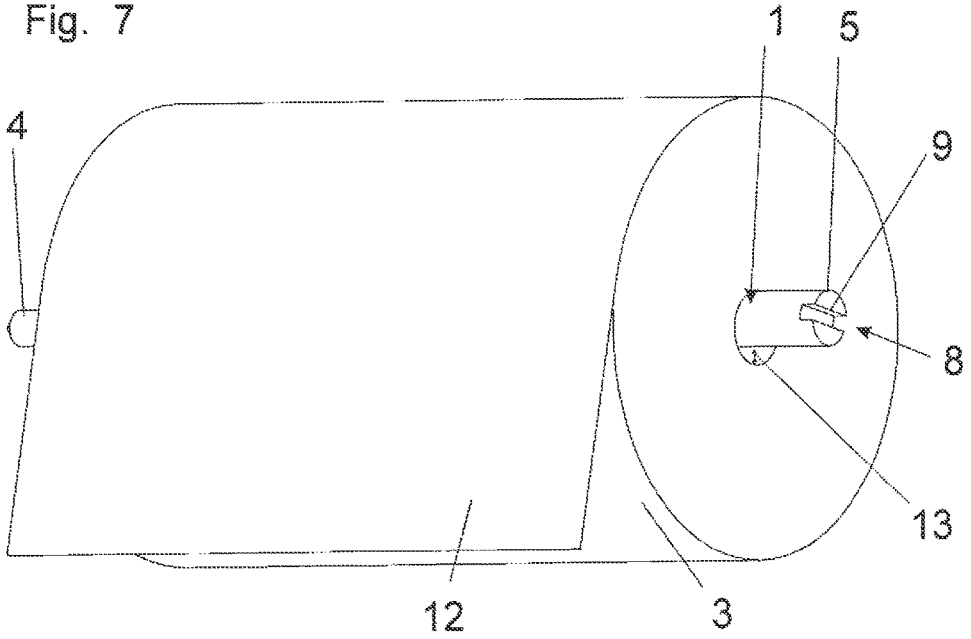
FIG. 7 shows a second exemplary embodiment of a material roll having a projecting support bar.
Figure 8:
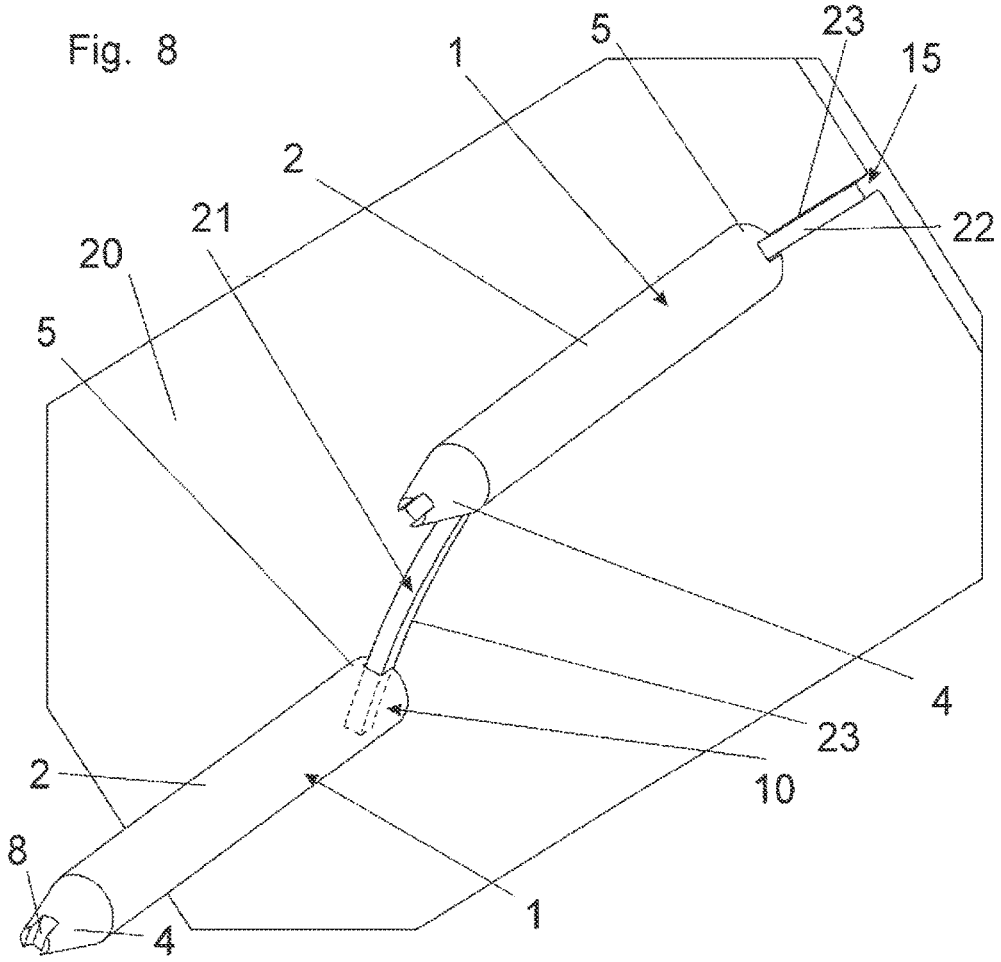
FIG. 8 shows an illustration, according to FIG. 3, of a second embodiment.

Since they are cut from a strand, material webs 12, in particular of domestic roll paper or sanitary roll paper, wound to form rolls 3, in general require bearing journals 4, 5 projecting on the end sides when, after opening a lid 25, they are inserted into guides 21, 24 of a dispenser 20 (cf. FIG. 1) and are rotatably mounted in a dispensing position 10 therein. The bearing journals 4, 5 here are provided on the ends of a support bar 1, wherein in the FIGS. 2, 3 and 7 a simple cylindrical bearing journal 4, which fits into a groove of a guide 24 of the dispenser 20, is drawn on the left. However, it is in principle also possible for the bearing journal 4 and the guide 24 thereof to be likewise configured as per the possibility described in the following for the bearing journal 5, shown on the right, and the guide 21 thereof, as shown in FIG. 8.

In order to be able to insert the rolls 3 into the various guides 21, 24 of the dispenser 20 in a positionally correct manner only, such that the material web 12 is always drawn off from the same side of the roll 3 (FIGS. 1, 7), the guide 21 is configured as a ridge 22 which projects from the wall of the dispenser 20 and which is continuous from the insertion position 15 through to the dispensing position 10 and onto which the correspondingly configured region of the bearing journal 5, in the insertion position 15, can be pushed. The bearing journal 5, therefore, on the free end side, has a groove 8 which is configured so as to be conversely disposed to the ridge 22 on the wall of the dispenser 20. The side walls of the groove 8 are mating surfaces 9 which, in contrast to the circumferential surface of the bearing journal 5, do not represent rotation surfaces but which are, in particular, planar, counter surfaces 23 being provided on the ridge 22. Since the ridge 22 extends not only in the insertion position 15 on the commencement of the guide 21 but across the entire length thereof up into the dispensing position 10, the roll 3 may rotate on the central region 2 of the support bar 1 when, as can be seen from FIG. 3, the roll 3 is pushed into the dispenser 20, from the insertion position 15 (on the right in FIG. 3) into the dispensing position 10 (on the left in FIG. 3), since the support bar 1 with the bearing journal 5 has to follow the curvature of the ridge 22, and, in the dispensing position 10, rotates on the support bar 1 when the material web 12 is drawn off in the direction of the arrow 11. The support bar 1 preferably is composed of a cost-effective plastic and, in the central region 2, displays recess clearances 6 in order to achieve dimensions which, without material accumulations worth mentioning, are within the capabilities of injection molding.

Between the innermost winding of the material web 12 and the support bar 1 there is dynamic friction, on account of which an advantageous braking effect is achieved when drawing off the material web 12 and, consequently, material wastage is avoided. However, the braking effect must not be so high that the material web 12 tears off in a wrong manner and/or cannot be drawn off at all. Favorable conditions exist when the breakaway torque (static friction), that is to say the force with which the end of the material web 12 hanging from the roll 3 has to be pulled, is 0.1 Nm, at most 0.2 Nm, and when the follow-on torque, after overcoming the breakaway torque, which is required for overcoming the dynamic friction does not drop below 0.0025 Nm.

Figure 3:
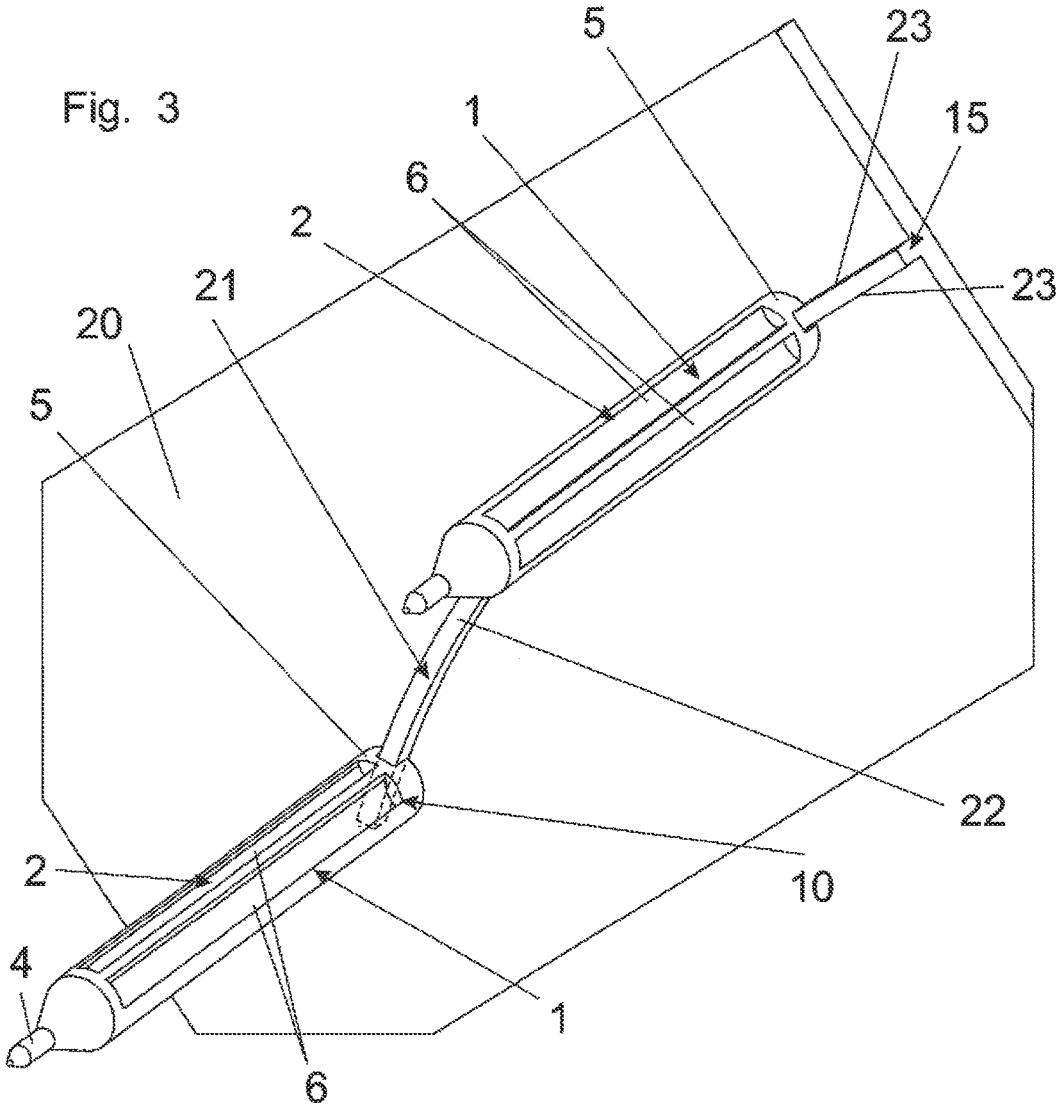
FIG. 3 shows a schematic illustration of a guide for the support bar on a side wall of the dispenser.
Figure 4:
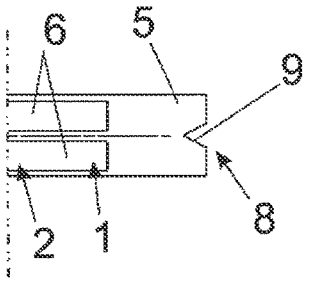
FIGS. 4 to 6 show exemplary embodiments for bearing journals having end-side grooves.
Figure 5:
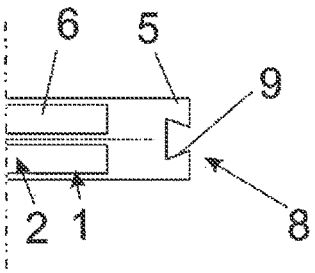
Figure 6:
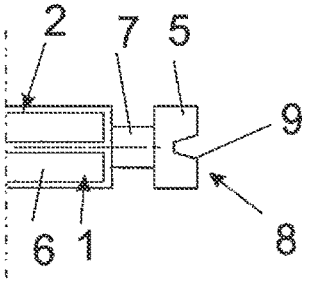

FIGS. 4 to 6 show various cross-sectional shapes for the groove 8 in the support bar 1 and the ridge 22 on the dispenser 20. While FIGS. 3 and 7 show a rectangular or square cross section, the cross section in FIG. 4 is configured to be triangular, in FIG. 5 to be dove-tail shaped and in FIG. 6 to be trapezoidal. A dove-tail shaped configuration as per FIG. 5 has the additional advantage that the support bar 1 is also held in its longitudinal direction on the ridge 22. In FIG. 6 a circumferential groove 7 in the bearing journal 5 is also shown, such that a support bar of this type may also be employed in a dispenser according to EP 1 927 308 mentioned at the outset.

A simplified implementation of a roll 3 is shown in FIG. 7, in which a clearance 13 remains between the winding and the support bar 1.

FIG. 8 shows a variant in which both guides 21, 24 of the dispenser and both bearing journals 4, 5 are configured so as to be of the same type. Only the width of the ridges 22 of the two guides 21, 24 and the width of the grooves 8 in the end sides of the two bearing journals 4, 5 differ, in order for the roll 3 to be inserted only in the correct position. The bearing journal 4, in its diameter, is reduced in a conical manner, in order to make possible and/or facilitate the insertion of the support bar 1 into a roll 3 which has been wound in a coreless manner. This support bar may also display material recess clearances 6 in the central region 2.

The invention claimed is:

1. A dispensing system, comprising:

a dispenser for dispensing portions of a material web wound on a roll that have to be severed;

a support bar formed with a central region supporting at least one material web wound to form the roll, said support bar, on each end thereof, having a respective bearing journal of two bearing journals projecting from the roll;

a mating surface formed on at least one of said two bearing journals and not configured as a rotation surface;

said dispenser having a respective guide for each of said two bearing journals extending from a commencement position and ending in a dispensing position; and said guide, for each of said bearing journals provided with said mating surface, having a counter surface at said commencement position, said counter surface extending across an entire length thereof into the dispensing position and being formed to enable an insertion of the roll into said dispenser only when said mating surface and said counter surface coincide;

wherein said roll is rotatably disposed on said central region of said support bar, and said support bar is rotationally fixed in said guide.

2. The dispensing system according to claim 1, wherein said mating surface is formed in an end-side groove of said bearing journal and said guide on said dispenser is a projecting ridge onto which said groove can be pushed.

3. The dispensing system according to claim 1, wherein said roll of said material web is a coreless roll.

* * * * *